US006470539B2

(12) United States Patent
Mizus

(10) Patent No.: US 6,470,539 B2
(45) Date of Patent: Oct. 29, 2002

(54) RELEASABLE TOUCH FASTENING SYSTEM

(76) Inventor: Irving Mizus, 3076 Cardiff Rd., Chevy Chase, MD (US) 20815

( * ) Notice: Subject to any disclaimer, the term of this patent is extended or adjusted under 35 U.S.C. 154(b) by 0 days.

(21) Appl. No.: 09/736,295

(22) Filed: Dec. 15, 2000

(65) Prior Publication Data

US 2002/0073517 A1 Jun. 20, 2002

(51) Int. Cl.[7] ..... A44B 18/00
(52) U.S. Cl. ..... 24/447; 24/450
(58) Field of Search ..... 24/442, 444, 447, 24/450; 428/98–100

(56) References Cited

U.S. PATENT DOCUMENTS 3,686,718 A * 8/1972 Brumlik ..... 24/306
3,753,458 A * 8/1973 Lazarek ..... 160/354
4,796,317 A * 1/1989 Kallman et al. ..... 24/72.5
5,133,112 A * 7/1992 Gomez-Acevedo ..... 24/306
5,695,845 A * 12/1997 Ogawa et al. ..... 24/442
5,819,391 A * 10/1998 Matsushima et al. ..... 24/442
5,901,419 A * 5/1999 Widlund et al. ..... 24/300
6,017,608 A * 1/2000 Braun et al. ..... 24/696
6,112,377 A * 9/2000 Wilson ..... 160/237

FOREIGN PATENT DOCUMENTS

JP 08-266313 * 10/1996

* cited by examiner

*Primary Examiner*—James R. Brittain
(74) *Attorney, Agent, or Firm*—Sughrue Mion, PLLC

(57) ABSTRACT

A fastening system that has a first planar surface with a front side and a back side and a plurality of fasteners. Each fastener is engaged with the first planar surface. Each fastener has a stem or member with a body, preferably in the shape of a sphere, attached to one end of the stem and an anchor attached to the other end of the stem. The body of the fastener is inserted into holes in a second planar surface to secure the first planar surface to the second planar surface.

32 Claims, 6 Drawing Sheets

RELEASABLE TOUCH FASTENING SYSTEM

BACKGROUND OF THE INVENTION

1. Field of the Invention

This invention relates to a touch fastening system having two planar surfaces that allow two structures to be fastened together. The fastening system is lightweight, easy to manufacture and is stronger and more stable than fastening systems conventionally known in the art.

2. Description of the Prior Art

Prior art touch fastening systems, used to join two surfaces together, have enjoyed great popularity. Generally, they consist of a first planar material and a second planar material. The first planar material has two sides. One side of the first piece carries, for example, loops, hooks, mushrooms, balls on stems or pigtails. The other side is attached to a first surface. The second planar surface also has two sides. One side of the second planar surface has loops, hooks, mushrooms, balls on stems or pigtails that engage with the loops, hooks, mushrooms, balls on stems or pigtails on the first planar surface. The other side of the second planar surface is attached to a second surface that is joined, through the first and second planar material, to the first surface. Velcro™ is a common example.

The first planar surface is engaged with the second planar surface by simply pressing the two surfaces together. To separate the two planar surfaces, the two touch fastener portions are pulled apart. When using this type of fastening system, the joining force between the first planar material and the second planar material is substantial, particularly in the shear direction. However, conventional touch fastening systems suffer from a number of disadvantages. First, moisture often decreases the joining force of the first and the second planar material. In addition, after repeated fastening and unfastening the first and second planar materials, the fastening force often decreases over time, particularly in the case of using hook and loop structures.

SUMMARY OF THE INVENTION

An object of the present invention is to provide a fastening system that provides a strong joining force between a first material and a second material in which joiner occurs simply.

Another object of the present invention is to provide a fastening system that provides a sufficient fastening strength regardless of the repetition of use.

An additional object of the present invention is to provide a fastening system that provides a strong joining force between a first material and a second material when the material is wet.

Accordingly, the fastening system according to a preferred embodiment of the present invention has a first planar surface with a front side and a back side and a plurality of fasteners, each fastener being slidably engaged with the first planar surface. Each fastener has a stem or member with a body, preferably in the shape of a sphere, attached to one end of the stem and an anchor attached to the other end of the stem. The body of the fastener is inserted into holes in a second planar surface.

Other features and advantages of the present invention will be apparent from the following more detailed description of the preferred embodiment, taken in conjunction with the accompanying drawings which illustrate, by way of example, the principles of the invention. The scope of the invention is not, however, limited to the preferred embodiment.

DETAILED DESCRIPTION OF THE PREFERRED EMBODIMENTS

Figure 1:
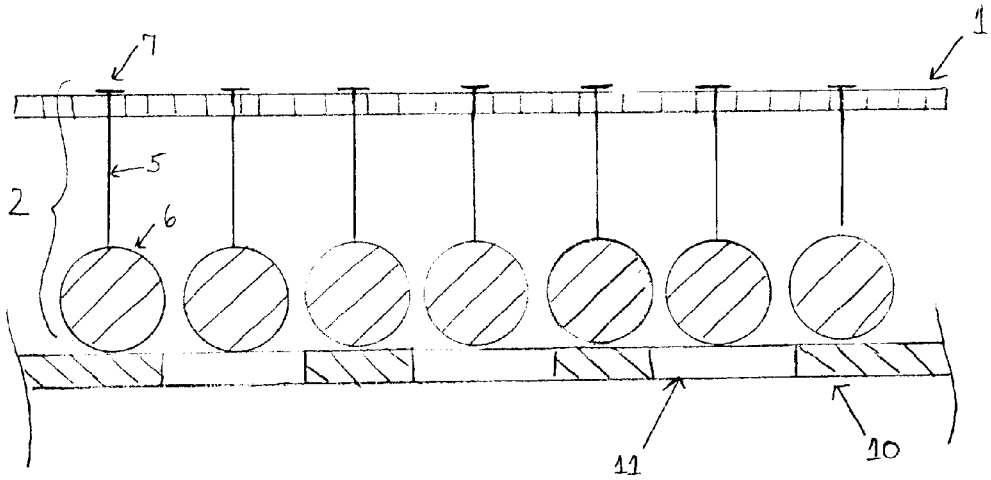
FIG. 1 is a side view of a touch fastening system according to a first embodiment of the present invention before attachment.

FIG. 1 depicts a side view of a touch fastening system according to a first preferred embodiment of the present invention. In these figures it will be appreciated that the scale is enlarged to explain the features of the invention. Fasteners 2 attached to a first planar surface 1 and depend from it. Each fastener 2 has a member or stem 5 with a proximal end and a distal end. A body 6 is attached to the distal end of the stem and an anchor 7 is attached to the proximal end of the stem 5. The existence of both the body 6 and the anchor 7 allow the fastener to slidably engage with the first planar surface 1 without separating therefrom.

A second planar surface 10 having holes 11 for receiving the body 6 of the fastener 2 correspond to the first planar surface. The bodies 6 are more numerous than the holes 11 to provide for a continuous attachment. The bodies 6 are relatively rigid and sized to permit them to fit through a hole 11.

Figure 2:
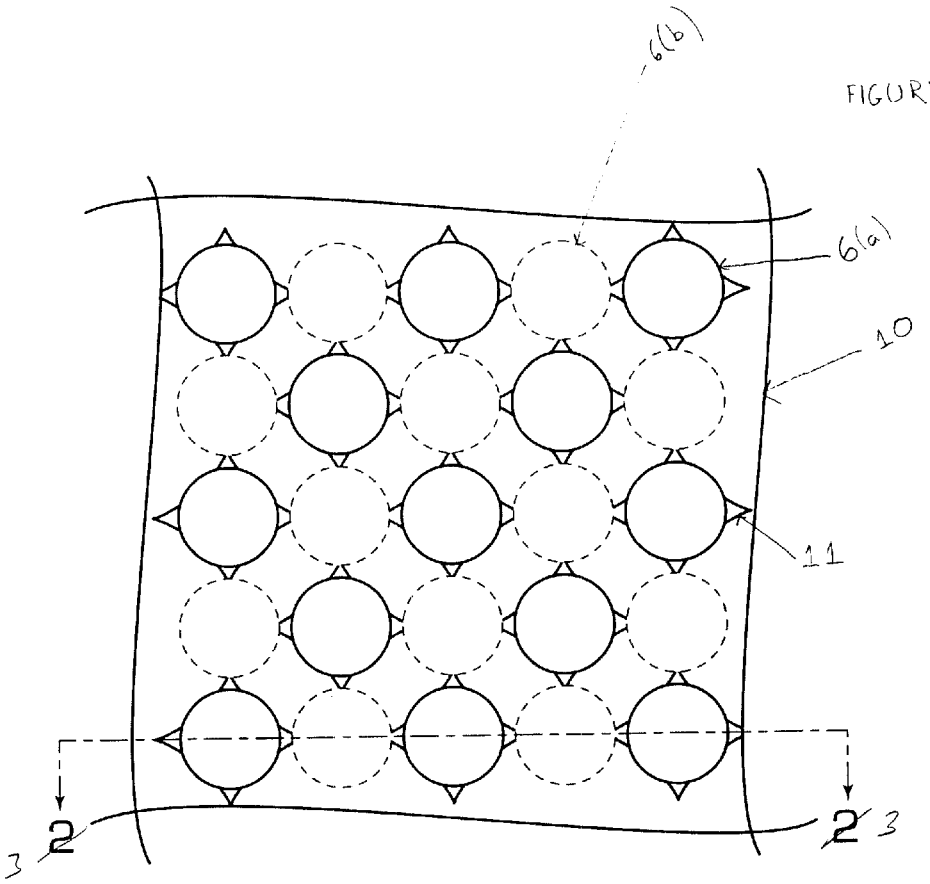
FIG. 2 depicts a plan view of a touch fastening system according to a first embodiment of the present invention.

FIG. 2 depicts a plan view of an underside of the second planar surface 10. The array is should as a regular pattern of holes, it being appreciated that the invention is not so limited. That is, the bodies and holes may be in a regular pattern or positioned randomly on each surface. Moreover, the holes 11 have deformable edges to allow the bodies to pass through and then retain them. FIG. 2 illustrates a scallop to each edge. When the first planar surface 1 is pressed into the second planar surface 10, a body 6 of the fastener 2 engages with the hole 11 of the second planar surface 10. When pressure is exerted, the body of the fastener is pressed into the hole 11. By application of pressure along a length of the planar surface a securing action of the first planar surface 1 to the second planar surface 10 occurs. The bodies 6 which do not protrude through the surface 10 retract via the stems 5.

Figure 3:
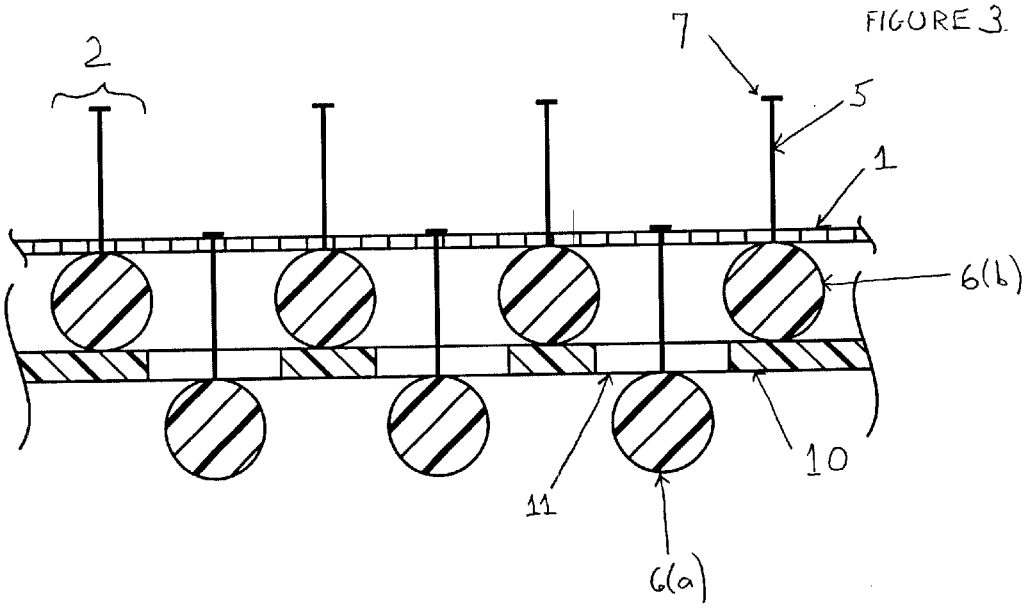
FIG. 3 depicts a side view of touch fastening system according to a first embodiment of the present invention after attachment.

FIG. 3 is a side view of FIG. 2 taken along line 3—3. As is clear, in this embodiment, the body of the fastener is pressed against the second planar surface 10 an some of the bodies (6*a*) will pass through the holes 11 and others (6*b*) will be blocked by the land portions 10. As illustrated, those bodies that are blocked retract into the first surface 1. The stems should be relatively rigid although deformable. The stems may abut against a backing member causing them to flex or bend. This creates a bias tending to urge the stems and bodies into an extended position. When the body engages with holes 11, the pressure forces the body of the fastener into the holes by slight deformation of the edges, securing the first planar surface to the second planar surface. The body of the fastener can be any size but, for best results, it is preferred that the body of the fastener is slightly larger than the holes in the second planar surface. This helps insure a secure bond between the first and the second planar surface. In addition, the body of the fastener can be any shape; however, it is preferred that the body have a spherical shape. Also, in this side view the gap between the first and second surfaces is greatly enlarged to explain the mode of attachment.

In this particular embodiment, the number of holes is less than the number of fasteners. This arrangement is advantageous in that the bodies 6(*b*) that are not inserted into the holes are used to stabilize the first and the second planar surfaces by providing a uniform degree of spacing . This more securely enforces the bond between the first and the second planar surfaces, decreasing the tendency for the first and second planar surfaces to disengage.

It will be apparent that the technique of disengagement simply requires peeling the surfaces apart. The bodies will be forced back through the holes 11 to their original position and the two surfaces separated.

Figure 4:
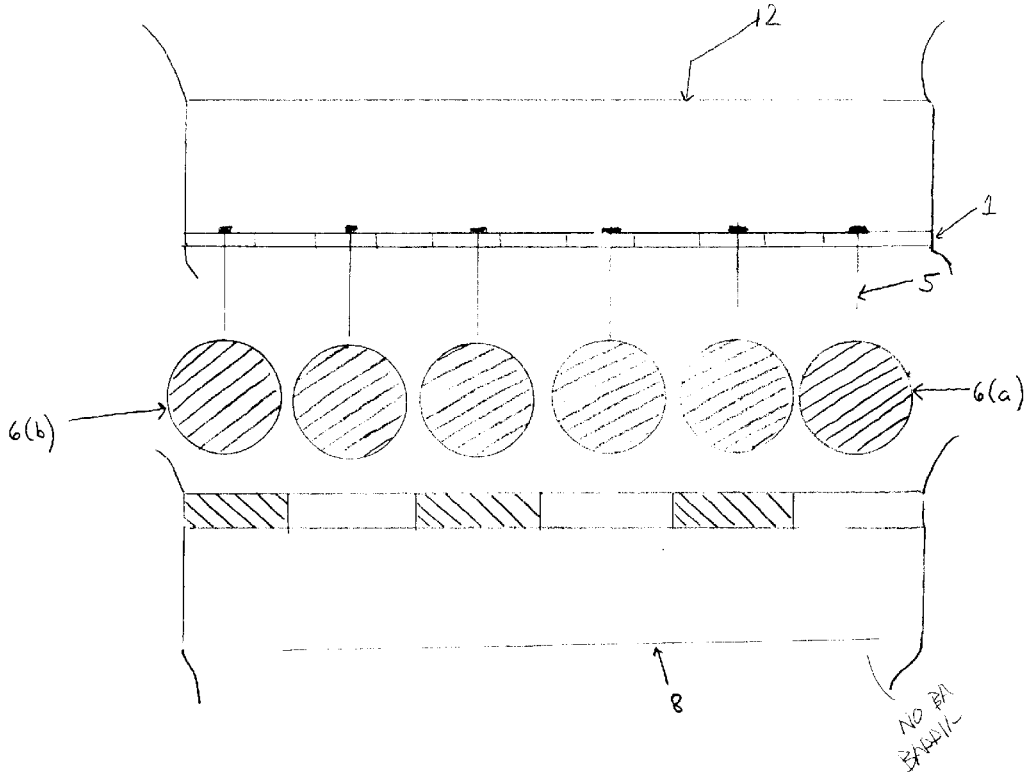
FIG. 4 depicts a side view of touch fastening system according to a second embodiment of the present invention.

FIG. 4 depicts a side view of a touch fastening system according to a second embodiment of the present invention. According to this embodiment, a material 12 is placed on one side of the first planar surface. It is preferable that this material be a low density deformable to receive the members or stems of the balls that are not inserted into the holes. In addition, a similar material 8 can also be placed on one end of the second planar surface. In this embodiment, the material placed on one end of the second planar surface should also be made from a sponge-like material. This sponge-like material can be used to receive the body of the fastener when it is pressed into the hole in the second planar surface.

Figure 5:
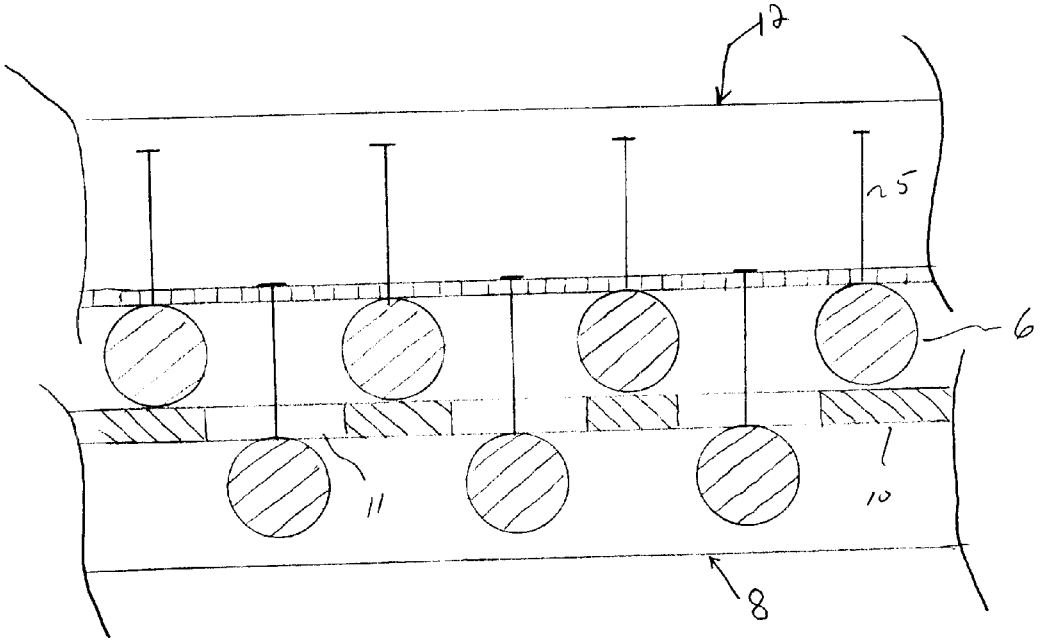
FIG. 5 depicts a side view of touch fastening system according to the second embodiment of the present invention after attachment.

FIG. 5 depicts a side view of the second embodiment of the touch fastening system with the layers in engagement with each other. The sponge-like material disposed on one side of the first planar surface and on one side of the second planar surface. As is clear, in this embodiment, the material 12 on the first planar surface receives the stems 5 of the fasteners and deforms or compresses while the material 8 on the second planar surface receives the bodies 6 of the fasteners that are inserted into the holes of the second planar surface. The purpose of this embodiment is to provide a fastening system that on the outside surfaces is relatively smooth and does not have either discontinuities or sharp points. Moreover by compression of the sponge-like material the bodies that do not engage are biased into an engagement position. It will be apparent that the compress force of the sponge-like material should be less than the force to deform the opening 11 that permits engagement.

Figure 6:
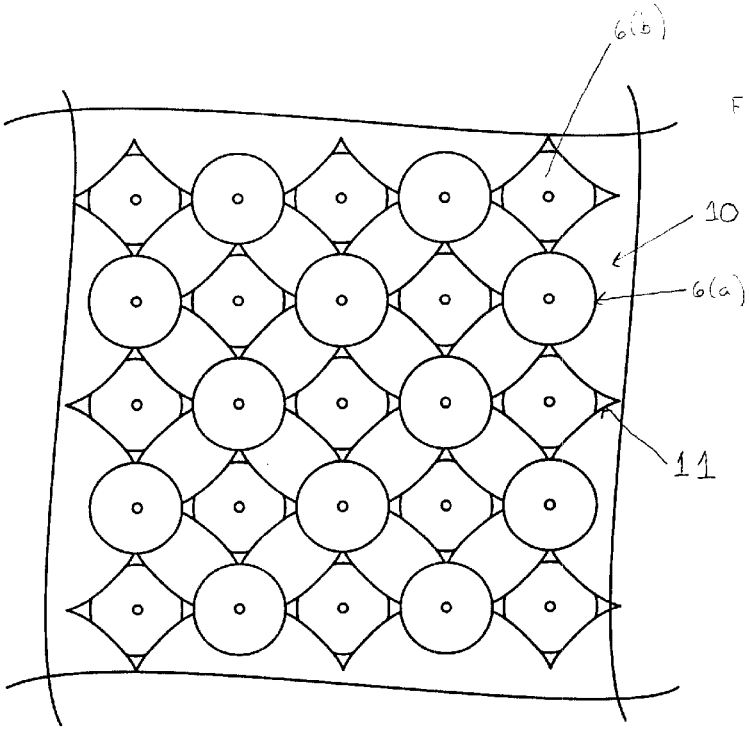
FIG. 6 depicts a plan view of a touch fastening system according to a third embodiment of the present invention.

FIG. 6 depicts a plan view of third embodiment of this invention employing a different type of second planar surface. This second planar surface has a number of holes that is equal to the number of balls. However, the diameter of these holes varies so that some of these holes receive balls and some do not. The purpose of this embodiment is to permit spacing of the bodies and to achieve a means of controlling the attachment force. That is, by regulating the density of attachment as a function of the number of holes in which attachment occurs, the attachment force can also be controlled.

Figure 7:
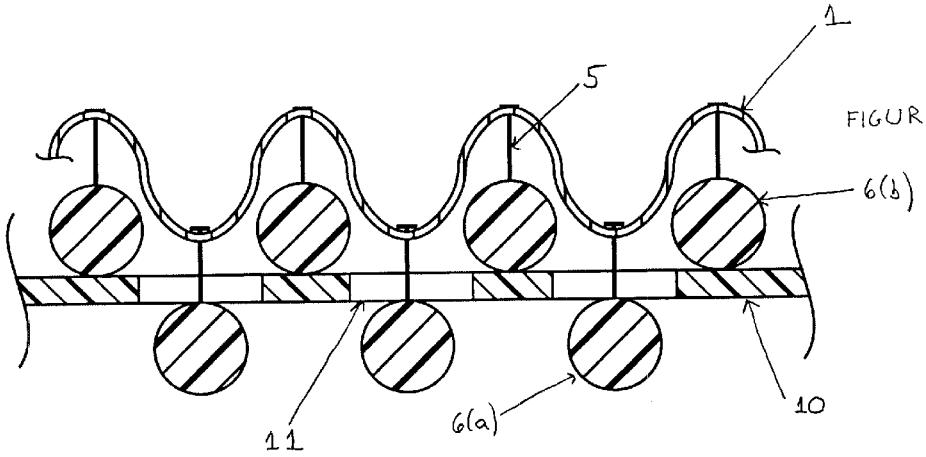
FIG. 7 depicts a side view of a touch fastening system according to a fourth embodiment of the present invention.

FIG. 7 depicts a side view of a fourth fastening system where the stems of the balls are not slidably engaged with the first planar surface, but are rigidly secured to the first planar surface 1. While the stems 5 are fastened to the first planar surface, the first planar surface is flexible, which allows the balls to be inserted into the holes. As illustrated in this embodiment the surface of the layer 1 takes the shape of the bodies that do not engage with the second surface, i.e., a rippled configuration when the two surfaces are in engagement. Again, it will be appreciated that the figure exaggerates the contour of the surfaces.

Figure 8:
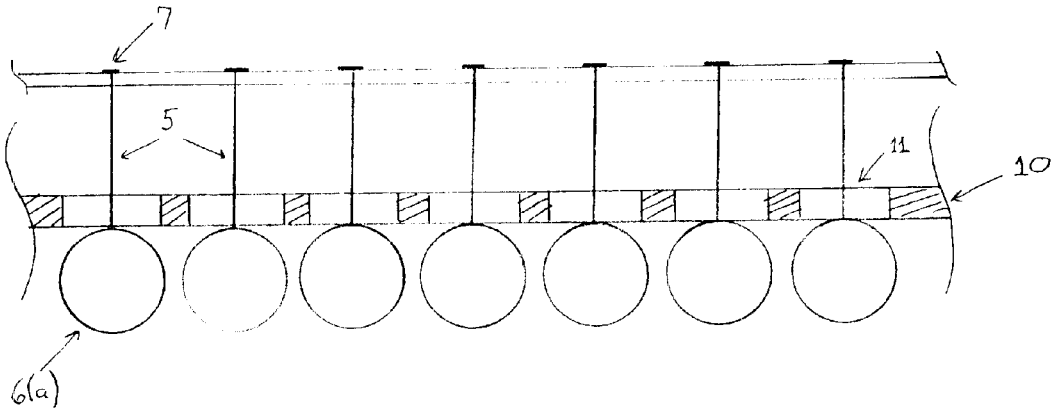
FIG. 8 depicts a side view of a touch fastening system according to a fifth embodiment of the present invention after attachment.

FIG. 8 is fifth embodiment of the present fastening system, wherein the number of holes 11 in the second planar surface is equal to the number of bodies 6. In this embodiment, the first planar surface can either be rigid or flexible. The stems do not retract but are affixed to the first surface.

It will be apparent that while this invention has been described with respect to the preferred embodiments there are modifications that may be practiced within the scope of the invention.

I claim:

1. A touch fastening system comprising:

a first planar surface having a front side and a back side;

a plurality of fasteners, each fastener having a stem slidably engaged with said first planar surface, said stem having a proximal end and a distal end and a body attached to the distal end of said stem disposed to the front side of said first planar surface; and a second planar surface having holes to receive at least some of said bodies.

2. A touch fastening system according to claim 1, wherein said fastener further comprises an anchor attached to the proximal end of said stem disposed to the back side of said first planar surface.

3. A touch fastening system according to claim 1, wherein the stem of said fastener is fixed with said first planar surface.

4. A touch fastening system according to claim 1, wherein the hole of said second planar surface has deformable edges to receive said body.

5. A touch fastening system according to claim 1, wherein said first planar surface is rigid.

6. A touch fastening system according to claim 1, wherein said first planar surface is flexible.

7. A touch fastening system according to claim 1, wherein said second planar surface is rigid.

8. A touch fastening system according to claim 1, wherein said second planar surface is flexible.

9. A touch fastening system according to claim 1 wherein the holes of said second planar surface have a diameter which is smaller that the widest portion of said body.

10. A touch fastening system according to claim 1, wherein said body is a sphere.

11. A touch fastening system according to claim 1, further comprising a substrate secured to the back side of said first planar surface, wherein said substrate is made of a low density deformable material.

12. A touch fastening system according to claim 1, further comprising a substrate secured to the back side of said second planar surface, wherein said substrate is made of a low density deformable material.

13. A touch fastening system according to claim 1, wherein a number of said plurality of fasteners is greater than a number of said plurality of holes.

14. A touch fastening system according to claim 1, wherein a number of said plurality of fasteners is equal to a number of said plurality of holes.

15. A touch fastening system according to claim 1, wherein the plurality of holes on said second surface each receive a body.

16. A touch fastening system comprising:

a first planar surface having a front side and a back side;

a plurality of fasteners, each fastener having a stem engaged with said first planar surface, said stem having a proximal end and a distal end and a body attached to the distal end of said stem disposed to the front side of said first planar surface;

a second planar surface having holes to receive at least some of said bodies, and a substrate secured to the back side of the second planar surface, wherein said substrate is made of a low density deformable material.

17. A touch fastening system according to claim 16, wherein said fastener further comprises an anchor attached to the proximal end of said stem disposed to the back side of said first planar surface.

18. A touch fastener system according to claim 16, wherein the stem of said fastening is slidably engaged with said first planar surface.

19. A touch fastener system according to claim 16, wherein the stem of said fastening is fixed with said first planar surface.

20. A touch fastener system according to claim 16, wherein the hole of said second planar surface has deformable edges to receive said body.

21. A touch fastening system according to claim 16, wherein said first planar surface is rigid.

22. A touch fastening system according to claim 16, wherein said first planar surface is flexible.

23. A touch fastening system according to claim 16, wherein said second planar surface is rigid.

24. A touch fastening system according to claim 16, wherein said second planar surface is flexible.

25. A touch fastening system according to claim 16, wherein the holes of said second planar surface have a diameter which is smaller that the widest portion of said body and said body is spherical.

26. A touch fastening system comprising:

a first planar surface having a front side and a back side;

a plurality of fasteners, each fastener having a stem engaged with said first planar surface, said stem having a proximal end and a distal end and a body attached to the distal end of said stem disposed to the front side of said first planar surface; and a second planar surface having an array of holes to receive at least some of said bodies, said array of holes arranged so that the bodies not engaged in the holes are positioned in a spaced relationship between said first and second planar surfaces to provide uniform spacing there between by contacting said second planar surface.

27. A touch fastening system according to claim 26, wherein said fastener further comprises an anchor attached to the proximal end of said stem disposed to the back side of said first planar surface.

28. A touch fastening system according to claim 26, wherein the stem of said fastener is slidably engaged with said first planar surface.

29. A touch fastening system according to claim 26, wherein the stem of said fastener is fixed with said first planar surface.

30. A touch fastening system according to claim 26, wherein the hole of said second planar surface has deformable edges to receive said body.

31. A touch fastening system according to claim 26, wherein a number of said plurality of fasteners is greater than a number of said plurality of holes.

32. A touch fastening system according to claim 26, wherein the plurality of holes of said second planar surface have a diameter which is smaller that the widest portion of the body of said plurality of fasteners.

* * * * *